US008147214B2

(12) United States Patent
Hirose

(10) Patent No.: US 8,147,214 B2
(45) Date of Patent: Apr. 3, 2012

(54) COMPRESSOR

(75) Inventor: Ryuichi Hirose, Kasukabe (JP)

(73) Assignee: Calsonic Kansei Corporation, Saitama-shi (JP)

( * ) Notice: Subject to any disclaimer, the term of this patent is extended or adjusted under 35 U.S.C. 154(b) by 856 days.

(21) Appl. No.: 12/145,137

(22) Filed: Jun. 24, 2008

(65) Prior Publication Data

US 2009/0028722 A1 Jan. 29, 2009

(30) Foreign Application Priority Data

Jun. 27, 2007 (JP) ..... P2007-169309

(51) Int. Cl.
*F04B 1/26* (2006.01)

(52) U.S. Cl. ..... 417/222.2; 417/269; 417/270; 92/71

(58) Field of Classification Search ..... 417/269, 417/270, 222.1; 91/499
See application file for complete search history.

(56) References Cited

U.S. PATENT DOCUMENTS

| | | | | |
|---|---|---|---|---|
| 3,057,545 | A * | 10/1962 | Ransom et al. | 417/269 |
| 5,009,286 | A * | 4/1991 | Ikeda et al. | 184/6.17 |
| 5,088,897 | A * | 2/1992 | Kawai et al. | 417/269 |
| 6,533,555 | B2 * | 3/2003 | Yamada et al. | 417/222.2 |
| 6,942,465 | B2 * | 9/2005 | Kawachi et al. | 417/269 |
| 2006/0245939 | A1 * | 11/2006 | Fukanuma et al. | 417/269 |

FOREIGN PATENT DOCUMENTS

| | | | |
|---|---|---|---|
| JP | 62-084681 | U | 5/1987 |
| JP | 08-326657 | A | 12/1996 |
| JP | 2000-297746 | A | 10/2000 |
| JP | 2003-343440 | A | 12/2003 |
| JP | 2007-127084 | A | 5/2007 |
| JP | 2007-127118 | A | 5/2007 |
| WO | WO 03/067087 | A1 | 8/2003 |
| WO | WO 2006/066830 | A1 | 6/2006 |

OTHER PUBLICATIONS

Patent Abstracts of Japan, 08-326657 Variable Displacement Compressor, Oct. 12, 1996.*
Patent Abstracts of Japan, 2002310067 Compressor, Oct. 23, 2002.*

* cited by examiner

*Primary Examiner* — Devon C Kramer
*Assistant Examiner* — Ryan Gatzemeyer
(74) *Attorney, Agent, or Firm* — Foley & Lardner LLP

(57) ABSTRACT

Provided is a compressor having an enhanced capability of supplying oil to a thrust bearing and a radial bearing which are interposed between a center through-hole in a cylinder block and a driving shaft. To this end, the compressor 1 has an air bleed passage 31 which is configured to allow crank chamber 5 and intake chamber 7 to communicate with each other, including: a first space S1 in the center through-hole 14; a communicating part 41 for allowing the first space S1 and a second space S2 to communicate with each other; the second space S2 in the center through-hole 14; a penetrating passage 43 formed to pass through the driving shaft 10, thereby allowing the second space S2 and a third space S3 to communicate with each other; the third space S3; and a communicating passage 45 for allowing the third space S3 and an intake chamber 7 to communicate with each other.

18 Claims, 5 Drawing Sheets

COMPRESSOR

BACKGROUND OF THE INVENTION

1. Field of the Invention

The present invention relates to a compressor.

2. Description of the Related Art

A type of compressor is disclosed, for example, in the Patent brochure of Japanese Utility Model Application, Laid-Open No. Sho. 62-84681. This type of compressor is configured to have: a cylinder block including a center through-hole and cylinder bores provided around the center through-hole; a valve plate which is jointed to a top-dead-center-side surface of the cylinder block, and which includes intake holes and exhaust holes; a rear head which is jointed to the cylinder block with the valve plate being interposed in between, and in which an intake chamber and an exhaust chamber both communicating with the cylinder bores are formed; a front head in which a crank chamber is formed, the crank chamber jointed to bottom-dead-center-side surfaces of the respective cylinder bores to communicate with the cylinder bores; pistons arranged in the respective cylinder bores to be reciprocatable therein; a driving shaft which is pivotally supported by the center through-hole in the cylinder block with a radial bearing and a thrust bearing being interposed in between, and which is rotatable in the crank chamber; and a conversion mechanism for converting rotations of the driving shaft to reciprocating motions of the respective pistons.

In this type of compressor, the pistons reciprocate back and forth in response to the rotation of the driving shaft. Thereby, a compressed medium is taken from the intake chamber into the cylinder bores, and is compressed there. The compressed medium thus compressed is discharged from the cylinder bores to the exhaust chamber. During the compression process carried out by the pistons, the compressed medium thus compressed to a high pressure (or a blow-by gas) flows into the crank chamber from the gap between the slide surfaces of each set of the cylinder bore and the piston. For the purpose of discharging the high-pressure compressed medium which flows into the crank chamber, an air supply passage for allowing the crank chamber and the intake chamber to communicate with each other is provided in the compressor. The high-pressure compressed medium in the crank chamber is fed back to the intake chamber through this air supply passage. In general, oil is retained in the crank chamber. This oil is splashed up into mist by the conversion mechanism located in the crank chamber, and the oil mist is supplied to the sliding members in the crank chamber. Part of the oil mist inevitably flows out of the crank chamber while accompanied by the compressed medium which flows out from the crank chamber to the intake chamber through the air supply passage. It is desirable, however, to keep the oil mist inside the crank chamber where the chief sliding members are located.

In the case of the current technology, for the purpose of retaining the oil mist inside the crank chamber, a part of the air supply passage is provided in the driving shaft and has an inlet at a portion of the outer peripheral surface of the driving shaft, which portion faces the crank chamber. As a result, when the oil mist in the crank chamber is going into the inlet of the air supply passage, the oil mist is pushed back to the crank chamber due to the centrifugal action of the driving shaft. Thereby, it is possible to retain much of the oil inside the crank chamber.

However, the compressed medium which flows from the crank chamber to the intake chamber tends not to flow to the center through-hole in the cylinder block. This makes it likely to supply only an insufficient amount of oil to the thrust bearing and the radial bearing which are interposed between the center through-hole in the cylinder block and the driving shaft.

Particularly in a structure in which the radial bearing is a slide bearing, there is no interstice in the bearing. For this reason, only an extremely small amount of compressed medium passes through the radial bearing. As a result, the radial bearing may run out of supplied oil.

SUMMARY OF THE INVENTION

The present invention has been made in view of the problem with the current technology. An object of the present invention is to provide a compressor having an enhanced capability of supplying oil to a thrust bearing and a radial bearing which are interposed between a center through-hole in a cylinder block and a driving shaft.

To achieve the object, a first aspect of the present invention is a compressor which includes: a cylinder block including a center through-hole and cylinder bores provided around the center through-hole; a partition plate which is jointed to a top-dead-center-side surface of the cylinder block, and which includes intake holes and exhaust holes; an intake chamber and an exhaust chamber which communicate with each of the cylinder bores with the partition plate being interposed in between; a crank chamber communicating with the cylinder bores in respective bottom-dead-center sides of the cylinder bores; pistons reciprocatably arranged in the respective cylinder bores; a driving shaft pivotally supported by the center through-hole in the cylinder block with a radial bearing and a thrust bearing being interposed in between; a conversion mechanism for converting rotations of the driving shaft to reciprocating motions of the respective pistons; and an air bleed passage for allowing the crank chamber and the intake chamber to communicate with each other. In the compressor, the center through-hole in the cylinder block is configured by including: a first space closer to the crank chamber beyond the thrust bearing; a second space between the thrust bearing and the radial bearing; and a third space closer to the intake chamber beyond the radial bearing. In addition, the air bleed passage is configured by including: the first space in the center through-hole; a communicating part for allowing the first space and the second space to communicate with each other; the second space in the center through-hole; a penetrating passage, formed to pass through the driving shaft, for allowing the second space and the third space to communicate with each other; the third space; and a communicating passage for allowing the third space and the intake chamber to communicate with each other.

In the first aspect of the present invention, a compressed medium to flow from the crank chamber to the intake chamber through the air bleed passage, in the following order. The compressed medium leaves crank chamber, passes through the first space in the center through-hole, the communicating part, the second space in the center through-hole, the penetrating passage formed to pass through the driving shaft, the third space, and the communicating passage for allowing the third space and the intake chamber to communicate with each other, then arrives the intake chamber. During its flow, the compressed medium flows through the second space located between the thrust bearing and the radial bearing. This flow supplies the thrust bearing and the radial bearing with oil which is included in the compressed medium.

In addition, because the inlet of the penetrating passage located downstream of this second space is open to the outer circumferential surface of the driving shaft, the oil included in the compressed medium, which attempts to go into the penetrating passage from the second space, is captured by the inlet of the penetrating passage due to the rotation of the driving shaft. The oil thus captured is pushed back to the second space due to the centrifugal force generated by the rotation of the driving shaft. For this reason, the oil thus centrifuged is collected in the second space, and the thrust bearing and the radial bearing located in the respective two sides of the second space are supplied with a sufficient amount of oil. Consequently, the lubricity increases in the thrust bearing and the radial bearing located in the center through-hole, because the sufficient amount of oil is capable of being supplied to the thrust bearing and the radial bearing.

A second aspect of the present invention is the compressor according to the first aspect, in which the communicating part for allowing the first space and the second space to communicate with each other is interstice in the thrust bearing.

In the second aspect of the present invention, the communicating part is interstices in the thrust bearing. For this reason, the communicating part does not have to be formed separately to pass through the cylinder block. This makes it possible to keep the manufacturing costs low.

A third aspect of the present invention is the compressor according to the first aspect or the second aspect, in which the communicating part for allowing the first space and the second space to communicate with each other is radial groove formed in a bearing surface for the thrust bearing. The bearing surface is a part of the inner peripheral surface of the center through-hole in the cylinder block, and is formed as a step surface in the inner peripheral surface thereof. The radial groove extends in the radial direction.

In the third aspect of the present invention, the communicating part is the radial groove formed in the bearing surface for the thrust bearing, the bearing surface being a part of the inner circumferential surface of the center through-hole in the cylinder block. This structure makes it possible to make the manufacturing costs lower than a structure in which the communicating part is formed to pass through the cylinder block. Furthermore, in the structure in which the communicating part is the interstice in the thrust bearing, much of the oil is separated from the compressed medium in the rotating thrust bearing.

This makes it likely that the amount of oil collected in the second space may become smaller. However, the third aspect of the present invention reduces the amount of compressed medium passing through the interstices in the thrust bearing, and thus decreases the amount of oil separated from the gas in the thrust bearing. Accordingly, the third aspect of the present invention is capable of collecting a larger amount of oil in the second space. This scheme makes it possible to supply both the thrust bearing and the radial bearing with a sufficient amount of oil.

A fourth aspect of the present invention is the compressor according to any one aspect among the first aspect to the third aspect, in which the multiple radial grooves are provided radiating from the second space to the outer periphery.

In the fourth aspect of the present invention, the multiple radial grooves are formed as the communicating part. This makes it possible to increase the total cross-sectional area of the communicating part as a passage, and thus to enhance the effect brought about by the third aspect of the present invention.

A fifth aspect of the present invention is the compressor according to any one aspect among the first aspect to the fourth aspect, in which the radial grooves are provided to be depressed from the bearing surface in an axis direction of the driving shaft.

In the fifth aspect of the present invention, the radial grooves are depressed from the bearing surface in the axis direction of the driving shaft. For this reason, the die cutting direction of the cylinder block (or the direction in which the center through-hole in the cylinder block extends, or the axial direction of the driving shaft) is equal to the direction in which the radial grooves are depressed. This makes it unnecessary that the radial grooves be additionally processed by cutting, and accordingly to keep the manufacturing costs low.

A sixth aspect of the present invention is the compressor according to any one aspect among the first aspect to the fifth aspect, in which an axial grooves are formed in a part of the inner peripheral surface of the center through-hole, which part is opposed to the outer periphery of the thrust bearing, the axial grooves being provided in the axis direction, and the axial grooves communicating with outer peripheral ends of the respective radial grooves.

In the sixth aspect of the present invention, even in a structure in which the gap between the outer peripheral surface of the thrust bearing in the center through-hole and inner peripheral surface of the center through-hole is narrow, the axial grooves secure a passage for allowing the first space and the radial passages to communicate with each other.

A seventh aspect of the present invention is the compressor according to any one aspect among the first aspect to the sixth aspect, in which the radial bearing is a slide bearing.

In the seventh aspect of the present invention, the radial bearing is a slide bearing. As a result, this structure tends to make smaller amount of oil supplied to the radial bearing. For this reason, the effects brought about by the foregoing aspect of the present invention are particularly effective for offsetting the tendency.

BRIEF DESCRIPTION OF THE ACCOMPANYING DRAWINGS

DESCRIPTION OF THE PREFERRED EMBODIMENTS

Figure 1:
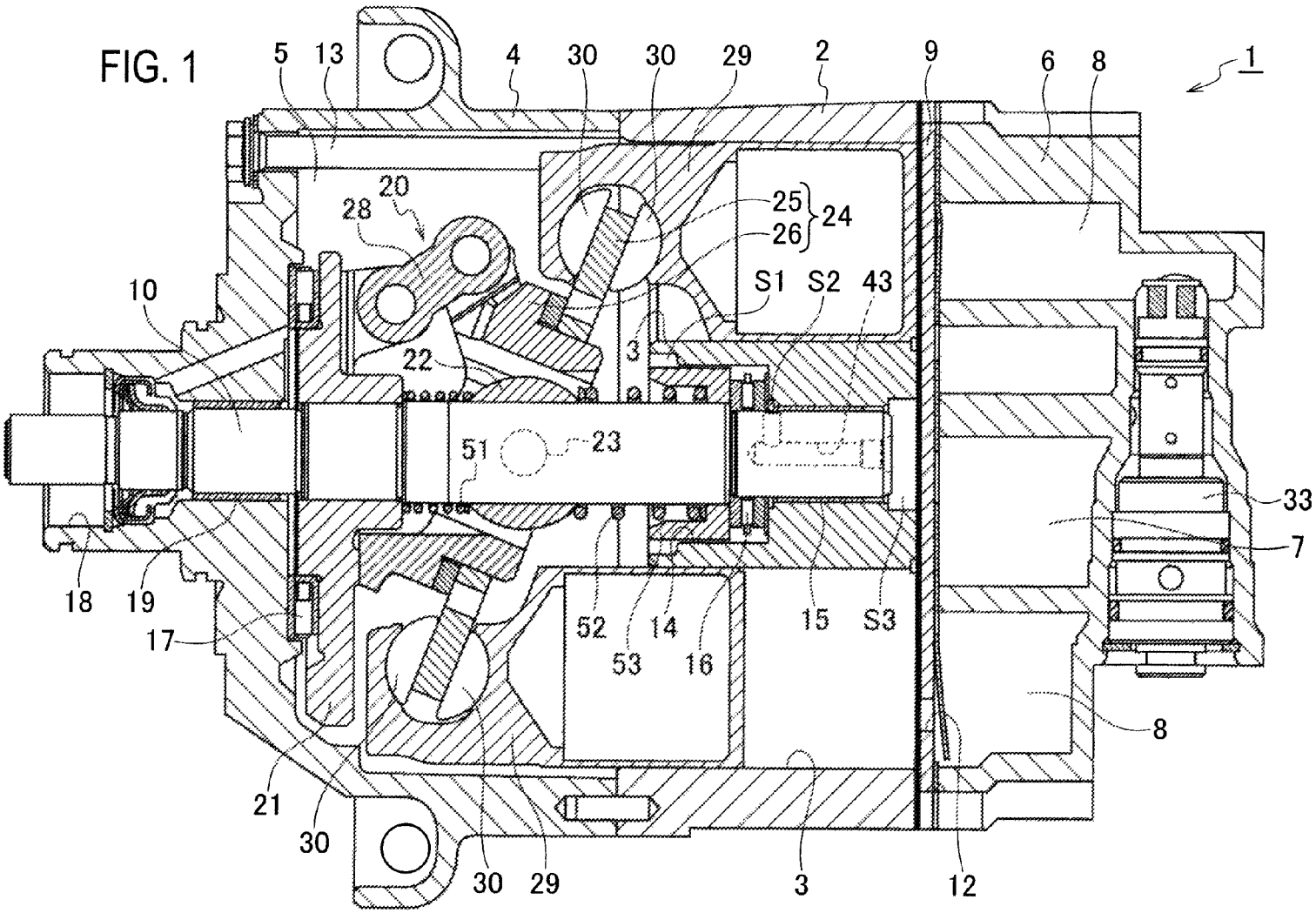
FIG. 1 is a cross-sectional view of a compressor according to an embodiment of the present invention.

Descriptions will be provided hereinbelow for a variable displacement compressor according to an embodiment of the present invention by referring to the drawings.

First of all, descriptions will be provided for an overall configuration of the compressor. FIG. 1 is an overall cross-sectional view of the compressor. It should be noted that FIG. 1 shows the compressor which is in a full stroke.

As shown in FIG. 1, the variable displacement compressor 1 according to the embodiment includes: a cylinder block 2; a front head 4 which is jointed to the front end surface of the cylinder block 2, and in which a cranks chamber 5 is formed;

and a rear head 6 which is jointed to the rear end surface of the cylinder block 2 with a valve plate 9 interposed in between, and in which an intake chamber 7 and an exhaust chamber 8 are formed. The cylinder block 2, the front head 4 and the rear head 6 are fixedly fastened to one another by use of multiple through-bolts 13, and thus form a housing for the compressor.

The valve plate 9 includes: intake holes 11 respectively for allowing cylinder bores 3 to communicate with an intake chamber 7 (see FIG. 2); exhaust holes 12 respectively for allowing the cylinder bores 3 to communicate with an exhaust chamber 8. An intake valve mechanism for opening and closing the intake holes 11 is provided to the valve plate 9 at its cylinder block 2 side. An exhaust valve mechanism (not illustrated) for opening and closing the exhaust holes 12 is provided to the valve plate 9 at its rear head 6 side. A gasket (not illustrated) is interposed between the valve plate 9 and the rear head 6, and the intake chamber 7 and the exhaust chamber 8 are thus kept hermetic.

A driving shaft 10 is pivotally supported by a center through-hole 14 and 18 as a bearing hole in the center of the cylinder block 2 and the front head 4 with a radial bearing 15 and 19 being interposed in between. This causes the driving shaft 10 to be rotatable in the crank chamber 5.

The multiple cylinder bores 3 are arranged at equal intervals in the circumferential direction around the center through-hole 14 in the cylinder block 2, and are formed penetrating the cylinder block 2. Pistons 29 are slidably housed in the respective cylinder bores 3 in this cylinder block 2.

In addition, a thrust bearing 17 is interposed between the front end surface of a rotor 21 fixed to the driving shaft 10 and the inner wall surface of the front head 4.

Furthermore, a thrust bearing 16 is interposed between a step surface formed in an end portion of the driving shaft 10 and a step surface 14*c* formed in the center through-hole 14. The radial bearing 15 in the center through-hole 14 in the cylinder block 2 is configured of a cylindrical slide bearing (bush) made of a plate-shaped member. Moreover, the thrust bearing 16 in the center through-hole 14 is configured of a rolling bearing which includes an outer lace and multiple needles as rolling bodies held in the outer lace.

A conversion mechanism 20 for converting the rotation of the driving shaft 10 to reciprocating motions of the respective pistons 29 is provided in the crank chamber. The conversion mechanism 20 is configured by including: the rotor 21 as a rotary member fixed to the driving shaft 10; a sleeve 22 slidably mounted on the driving shaft 10 in its axial direction; an inclined plate 24 as a tilt member which is connected to the sleeve 22 by use of a pivot pin 23, and which is tiltable relative to the sleeve 22; a connecting mechanism 28 for connecting the rotor 21 to the inclined plate 24 in order that the rotating torque of the rotor 21 can be transmitted to the inclined plate 24 while allowing the inclination angle of the inclined plate 24 to change; and a pair of hemispherical piston shoes 30 and 30 interposed between the inclined plate 24 and each piston 29 in order that the piston 29 is connected to an outer peripheral portion of the inclined plate 24.

The inclined plate 24 is mounted on the driving shaft 10 by use of the sleeve 22 and the pivot pin 23. As a result, the inclined plate 24 is mounted thereon tiltably to the driving shaft 10 and slidably on the driving shaft 10 in the axial direction of the driving shaft 10. In this case of the example, the inclined plate 24 has a hub 25 in its center portion, and an inclined plate main body 26 which is shaped like a plate, and which is fixed to a boss part of the hub 25.

The inclination angle of the inclined plate 24 decreases as the sleeve 22 moves closer to a cylinder block 2 against the return spring 52. On the other hand, the inclination angle of the inclined plate 24 increases as the sleeve 22 moves in a direction in which the sleeve 22 goes away from the cylinder block 2 against the return spring 52. Reference numeral 53 in the figures denotes a spring holding member which is formed in a shape of a closed-end cylinder for the purpose of holding the return spring.

Once the driving shaft 10 rotates, this configuration causes the inclined plate 24 to rotate along with the rotor 21, and concurrently causes the pistons 29 to reciprocate with a stroke depending on the inclination angle of the inclined plate 24. In response to the reciprocating motion of the pistons 29, a compressed medium (for example, a coolant) is taken into the cylinder bores 3 through an external circulation circuit, the intake chamber 7, and the intake holes in the valve plate 9. The compressed medium is compressed to a high temperature and a high pressure in the cylinder bores 3. Thereafter, the resultant compressed medium is exhausted from the cylinder bores 3, through the exhaust holes 12 in the valve plate 9 and the exhaust chamber 8 to the external circulation circuit.

The volume of exhausted coolant is changed by changing the inclination angle of the inclined plate 24 and the strokes of the pistons. More specifically, the differential pressure (or the pressure balance) between the pressure Pc in the crank chamber behind each piston 29 and the pressure Ps in the intake chamber in front of the piston 29 is controlled. This control changes the inclination angle of the inclined plate 24, and accordingly changes the strokes of the pistons. To this end, a pressure controlling mechanism is provided to this variable displacement compressor. The pressure controlling mechanism is configured by including: an air bleed passage 31 which causes the crank chamber 5 and the intake chamber 7 to communicate with each other (see FIG. 3); an air supply passage (not illustrated) which causes the crank chamber 5 and the exhaust chamber 8 to communicate with each other; and a control valve 33, provided in the middle of the air supply passage, for controlling the opening and closing of the air supply passage.

Because the air bleed passage 31 always causes the crank chamber 5 and the intake chamber 7 to communicate with each other, the coolant gas always leaks from the crank chamber 5 to the intake chamber 7 through the air bleed passage 31 irrespective of the opening/closing operation of the air supply passage by the control valve 33.

Once the control valve 33 opens the air supply passage, the high-pressure coolant gas flows into the crank chamber 5 from the exhaust chamber 8 through the air supply passage. Accordingly, the pressure in the crank chamber 5 rises. Once the pressure in the crank chamber 5 rises, the inclination angle of the inclined plate 24 decreases while the sleeve 22 moves closer to the cylinder block 2. As a result, the stroke of each piston decreases, and the exhaust amount accordingly decreases.

On the other hand, once the control valve 33 closes the air supply passage, the pressure difference between the intake chamber 7 and the crank chamber 5 gradually decreases, and the pressure in the intake chamber 7 becomes finally equal to the pressure in the crank chamber 5. In response to this, the inclination angle of the inclined plate 24 increases while the sleeve 22 moves in the direction in which the sleeve 22 goes away from the cylinder block 2. As a result, the stroke of each piston increases, and the exhaust amount accordingly increases.

Next, descriptions will be provided for a structure of the inside of the center through-hole 14 in the cylinder block 2.

The center through-hole 14 in the cylinder block is configured by including a large-diameter part 14*a* and a small-diameter part 14*b*. The thrust bearing 16 is arranged in the center through-hole 14 in the cylinder block, on a side closer to the crank chamber. The radial bearing 15 is arranged in another side of the center through-hole 14 therein, which is the side closer to the intake chamber. The step surface 14*c* located in the boundary between the large-diameter part 14*a* and the small-diameter part 14*b* serves as a bearing surface 14*c* receiving the thrust bearing 16.

In addition, the bearings 15 and 16 partition (divide) the center through-hole 14 in the cylinder block into: a first space S1 which is closer to the crank chamber 5 beyond the thrust bearing 16 and which is located between the crank chamber 5 and the thrust bearing 16; a second space S2 between the thrust bearing 16 and the radial bearing 15; and a third space S3 which is closer to the intake chamber 7 beyond the radial bearing 15 and which is located between the intake chamber 7 and the radial bearing 15.

Figure 2:
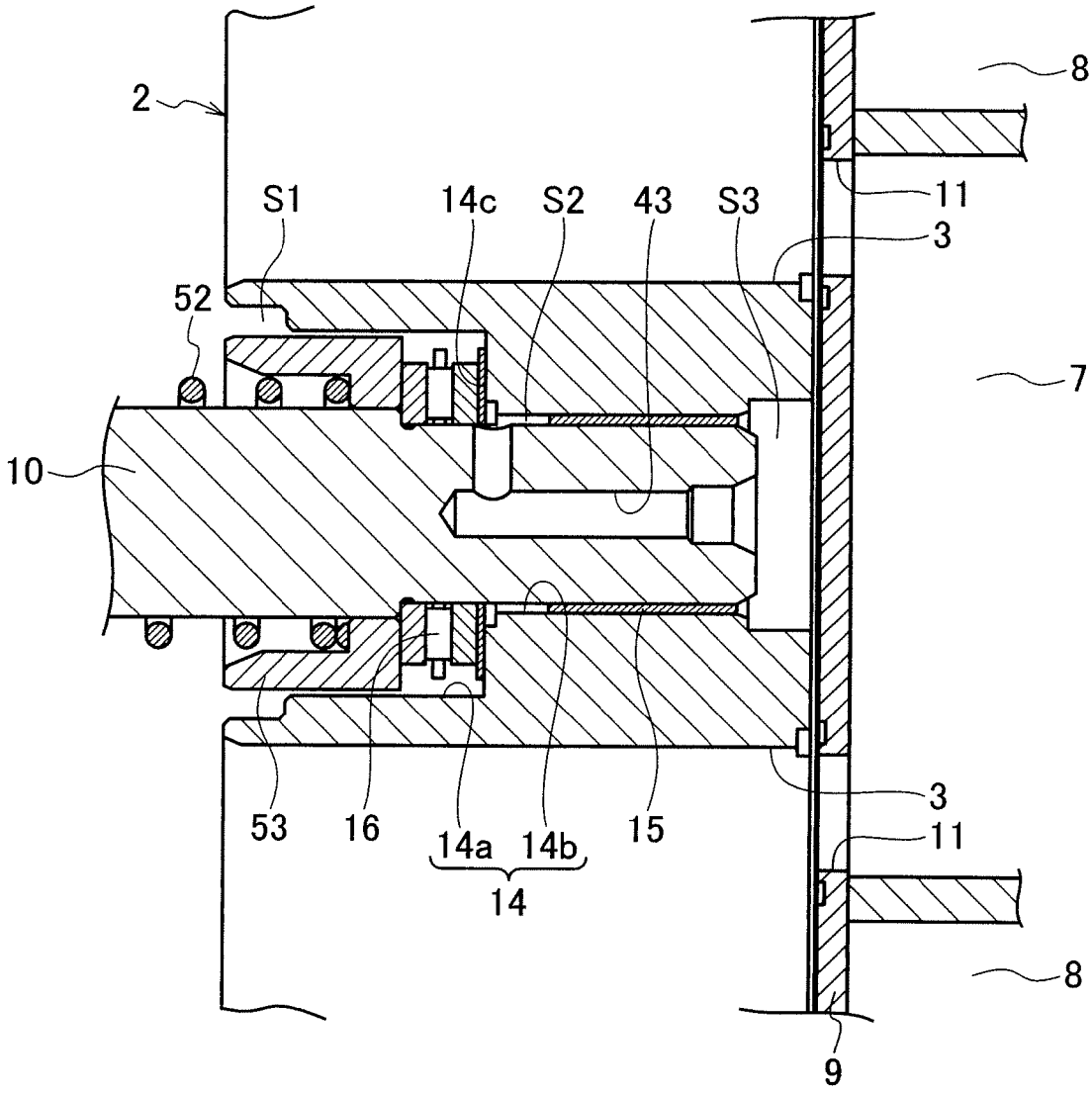
FIG. 2 is a magnified cross-sectional view of a center through-hole and its vicinity of a cylinder block in the compressor.
Figure 3:
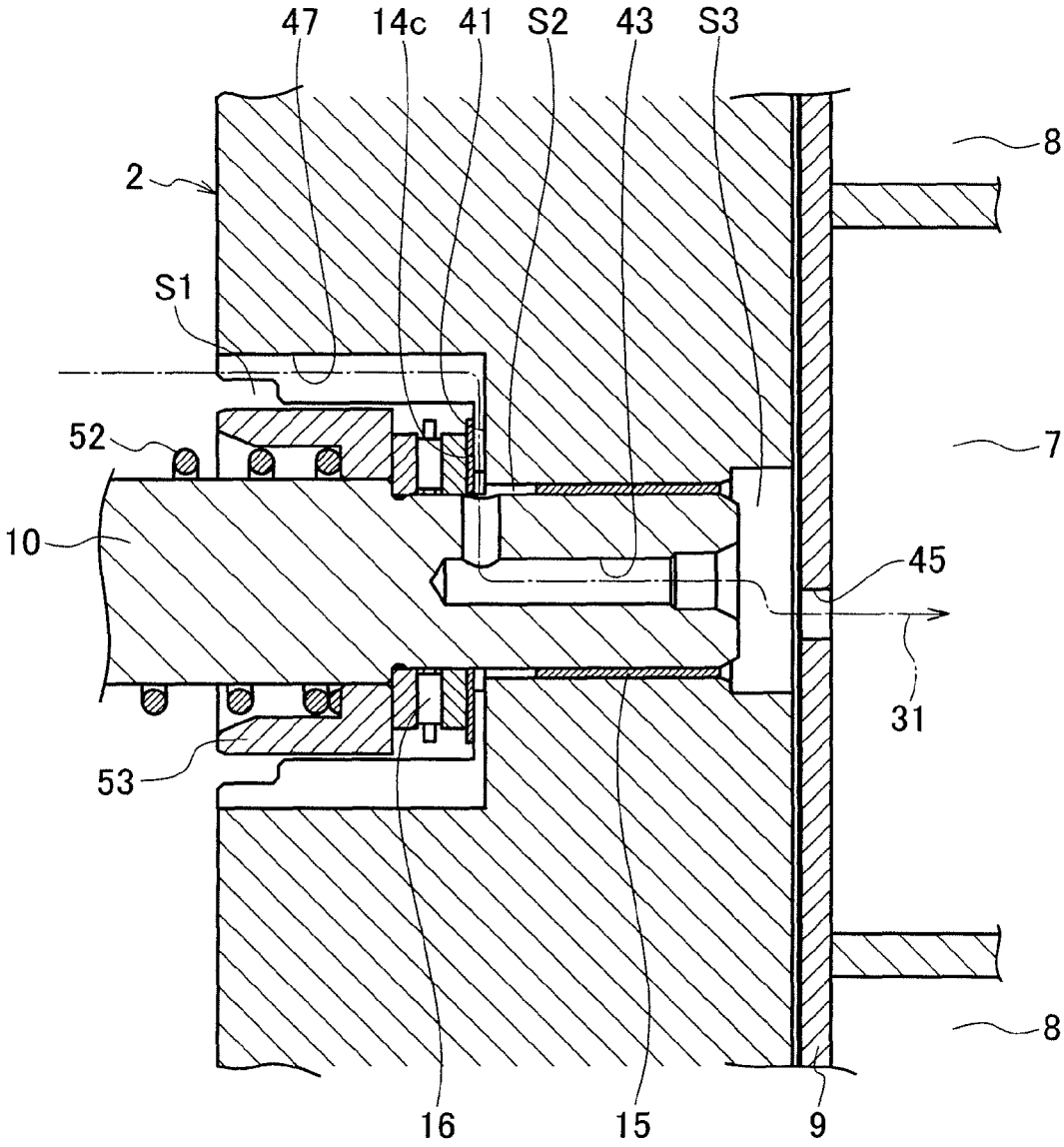
FIG. 3 is a magnified cross-sectional view of the center through-hole and its vicinity of the cylinder block, taken along a line different from a line along which the magnified cross-sectional view thereof shown in FIG. 2 is taken.

Next, detailed descriptions will be provided for the air bleed passage 31 by referring to FIGS. 2 and 3.

The air bleed passage 31 is configured by including: the first space S1 in the center through-hole; a communicating part 41 for allowing the first space S1 and the second space S2 to communicate with each other; the second space S2 in the center through-hole; a penetrating passage 43, formed to pass through the driving shaft 10, for allowing the second space S2 and the third space S3 to communicate with each other; the third space S3; and a communicating passage 45, formed to pass through the valve plate 9, for allowing the third space S3 and the intake chamber 7 to communicate with each other.

The communicating part 41 for allowing the first space S1 and the second space S2 to communicate with each other may be interstices in the thrust bearing 16. In the present embodiment, the communicating part 41 is radial grooves 41 extending in the radial directions, formed in the step surface 14*c* (or the bearing surface for the thrust bearing) in the inner circumferential surface of the center through-hole 14 in the cylinder block.

Figure 4:
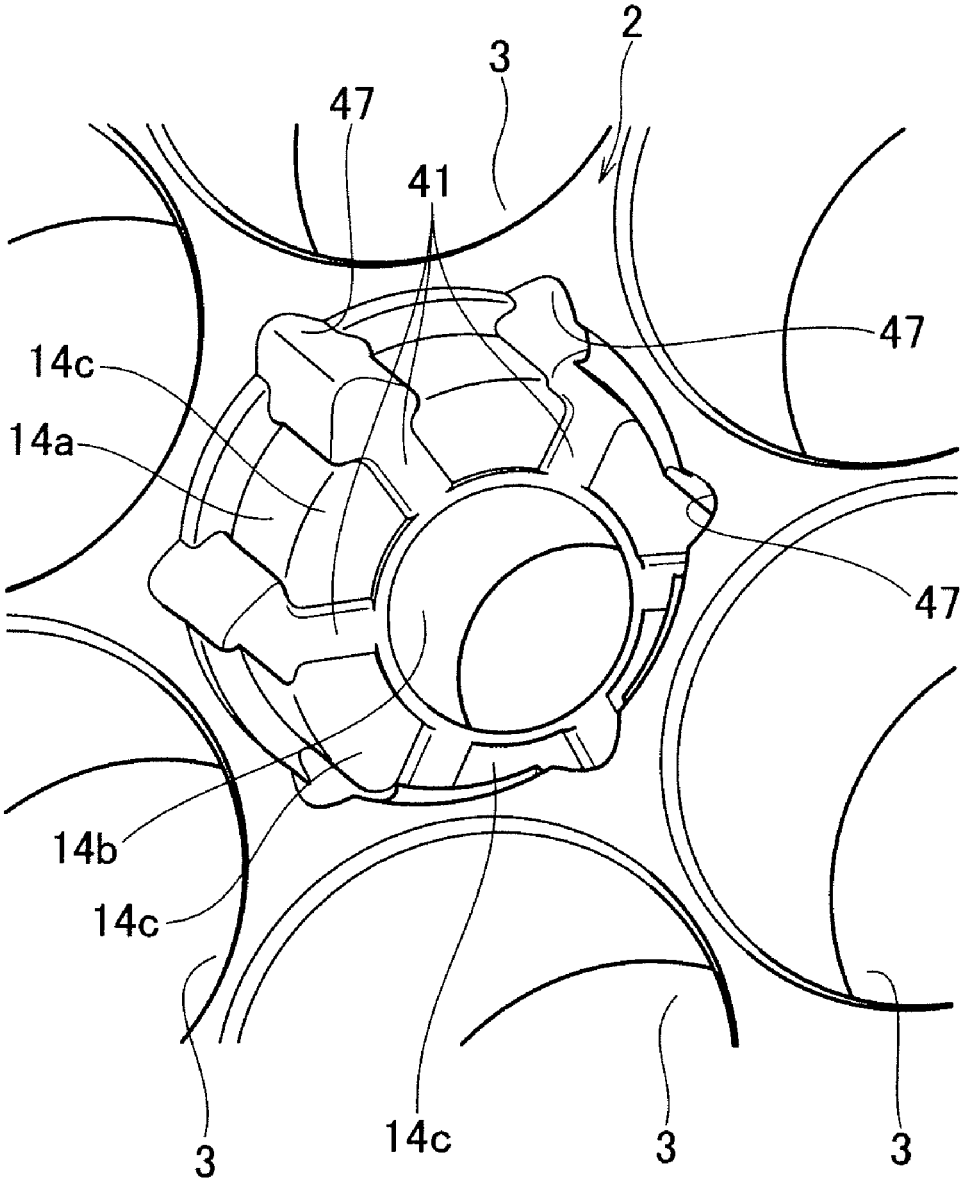
FIG. 4 is a perspective view of the cylinder block in the compressor.

As shown in FIG. 4, the multiple radial grooves 41 are provided radiating from the second space S2 to the outer periphery, and are depressed from the bearing surface 14*c* in the axis direction of the driving shaft 10.

Axial grooves 47 provided in the axial direction are formed in parts of the inner circumferential surface of the center through-hole 14, which are the parts opposed to the outer periphery of the thrust bearing 16. These axial grooves 47 communicate with the outer peripheral ends of the radial grooves 41, respectively. For this reason, even though a gap between the inner peripheral surface of the center through-hole 14 and the outer peripheral surface of the thrust bearing 16 is narrow, the cross-sectional area of the first space S1 as the passage is large enough. This ensures that the coolant flows from the crank chamber 5 to the communicating part 41.

This configuration causes the coolant to flow from the crank chamber to the intake chamber through the air bleed passage 31, in the following order. The compressed medium leaves crank chamber 5, passes through the first space S1 in the center through-hole, the communicating part 41, the second space S2 in the center through-hole, the penetrating passage 43 formed to pass through the driving shaft 10, the third space S3, and the communicating passage 45 for allowing the third passage S3 and the intake chamber 7 to communicate with each other, then arrives the intake chamber 7.

During its flow, the coolant flows through the second space S2 between the thrust bearing 16 and the radial bearing 15. For this reason, oil included in the coolant is supplied to the thrust bearing 16 and the radial bearing 15. In addition, because the inlet of the penetrating passage 43 existing downstream of the second space S2 is open to the outer circumferential surface of the driving shaft 10, the oil included in the coolant which attempts to go into the penetrating passage 43 from the second space S2 is captured by the inlet of the penetrating passage 43 due to the rotation of the driving shaft 10. The oil thus captured is pushed back to the second space S2 due to the centrifugal force generated by the rotation of the driving shaft 10.

For this reason, the oil thus centrifuged is collected in the second space S2, and the thrust bearing 16 and the radial bearing 15 located in the respective two sides of the second space S2 are supplied with a sufficient amount of oil. Consequently, the lubricity increases in the thrust bearing 16 and the radial bearing 15 located in the center through-hole 14, because the sufficient amount of oil is capable of being supplied to the thrust bearing 16 and the radial bearing 15.

The results and the effects of the present embodiment will be summarized hereinafter.

(1) In the compressor 1 according to the present embodiment, the air bleed passage 31 for allowing the crank chamber 5 and the intake chamber 7 to communicate with each other is configured by including: the first space S1 in the center through-hole; the communicating part 41 for allowing the first space S1 and the second space S2 to communicate with each other; the second space S2 in the center through-hole; the penetrating passage 43, formed to pass through the driving shaft 10, for allowing the second space S2 and the third space S3 to communicate with each other; the third space S3; and the communicating passage 45 for allowing the third space S3 and the intake chamber 7 to communicate with each other.

This configuration causes the coolant to flow from the crank chamber 5 to the intake chamber 7 through the air bleed passage 31, in the following order. The coolant leaves crank chamber 5, passes through the first space S1 in the center through-hole, the communicating part 41, the second space S2 in the center through-hole, the penetrating passage 43 formed to pass through the driving shaft 10, the third space S3, and the communicating passage 45 for allowing the third space S3 and the intake chamber 7 to communicate with each other, then arrives the intake chamber 7.

During its flow, the coolant flows through the second space S2 located between the thrust bearing 16 and the radial bearing 15. This flow supplies the thrust bearing 16 and the radial bearing 15 with oil which is included in the coolant. In addition, because the inlet of the penetrating passage 43 located downstream of this second space S2 is open to the outer circumferential surface of the driving shaft 10, the oil included in the coolant, which attempts to go into the penetrating passage 43 from the second space S2, is captured by the inlet of the penetrating passage 43 due to the rotation of the driving shaft 10. The oil thus captured is pushed back to the second space S2 due to the centrifugal force generated by the rotation of the driving shaft 10.

For this reason, the oil thus centrifuged is collected in the second space S2, and the thrust bearing 16 and the radial bearing 15 located in the two sides of the second space S2 are supplied with a sufficient amount of oil. Consequently, the lubricity increases in the thrust bearing 16 and the radial bearing 15 located in the center through-hole 14, because the sufficient amount of oil is capable of being supplied to the thrust bearing 16 and the radial bearing 15.

(2) In the compressor 1 according to the present embodiment, the radial bearing 15 is a slide bearing.

In general, the coolant flows from the second space S2 to the third space S3 through the interstices in the radial bearing 15 in a case where the radial bearing 15 is a rolling bearing. As a result, the oil is easily supplied to the radial bearing 15. In the present embodiment, however, the coolant is incapable of flowing through the radial bearing 15 because the radial bearing 15 is a slide bearing. As a result, the structure of the compressor 1 according to the present embodiment tends to make smaller amount of oil supplied to the radial bearing 15. For this reason, the above-described effect (1) is particularly effective for offsetting the tendency.

(3) In this respect, in the structure in which the communicating part 41 for allowing the first space S1 and the second space S2 to communicate with each other is interstices in the thrust bearing 16, much of the oil is separated from the coolant in the rotating thrust bearing 16 while the coolant is flowing from the first space S1 to the second space S2. This makes it likely that the amount of oil collected in the second space S2 may become smaller.

In the compressor 1 according to the present embodiment, however, the communicating part 41 is the radial grooves 41 formed in the bearing surface 14*c* for the thrust bearing, the bearing surface 14*c* being a part of the inner peripheral surface of the center through-hole 14. As a result, much of the coolant flows from the first space S1 to the second space S2 through the radial grooves 41, and little of the coolant flows through the interstices in the thrust bearing 16. This decreases the amount of oil separated from the gas in the thrust bearing 16, and much of the oil can be accordingly collected in the second space S2. This scheme makes it possible to supply both the thrust bearing 16 and the radial bearing 15 with a sufficient amount of oil.

In the present embodiment, the communicating part 41 is such grooves. This structure makes it possible to make the manufacturing costs lower than a structure in which the communicating part 41 is formed to pass through the cylinder block 2.

(Result of Experiment)

Figure 5:
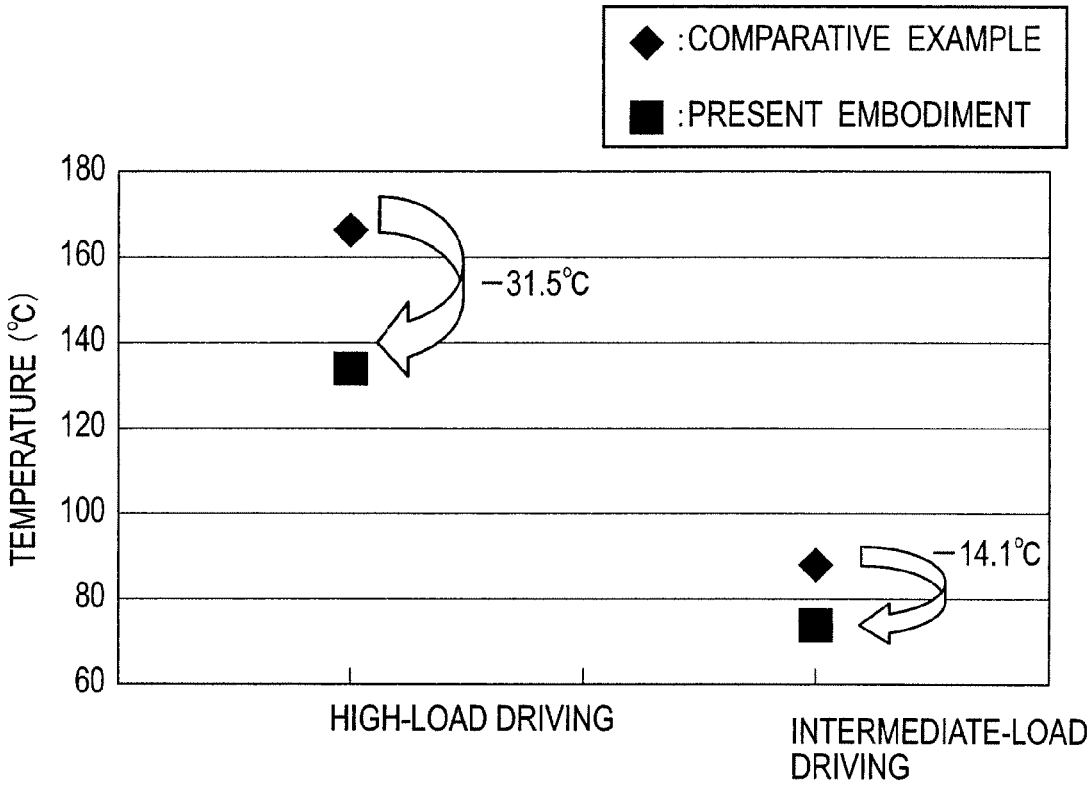
FIG. 5 is a graph showing a result of comparison in temperature of a radial shaft in the center through-hole between the embodiment in which a communicating part is radial grooves and a comparative example in which the communicating part is interstices in a thrust bearing.

An experiment was conducted to compare in the change in temperature of the radial bearing 15 between the structure (as a comparative example) in which the communicating part 41 is interstices in the thrust bearing 16 and the structure (as the present embodiment) in which the communicating part 41 is the radial groves 41 formed in the bearing surface 14*c* for the thrust bearing. As a result of the experiment, it was observed that, as shown in FIG. 5, the radial bearing 15 of the present embodiment was lower in temperature by 31° C. than the radial bearing 15 of the comparative example when the compressor was operated with a high load (with a high pressure Pd=24 Kg/cm$^2$G), and that the radial bearing 15 of the present embodiment was lower in temperature by 14° C. than the radial bearing 15 of the comparative example when the compressor was operated with an intermediate load (with a high pressure Pd=16 Kg/cm$^2$G). Incidentally, the experiment was conducted by operating the compressor at a high speed, at a number of revolutions 5500 rpm, for both the high-load operation and the intermediate-load operation.

It is learned that the effect of supplying the oil to the bearings 15 and 16 was more remarkable as a result of forming the communicating part 41 as grooves in the bearing surface 14*c* for the thrust bearing.

(4) In the compressor 1 according to the present embodiment, the multiple radial grooves 41 are provided radiating from the second space S2 to the outer periphery. This makes it possible to increase the total cross-sectional area of the communicating part 41 as a passage, and thus to enhance the above-described effect (3).

(5) In the compressor 1 according to the present embodiment, the radial grooves 41 are depressed from the bearing surface 14*c* in the axis direction of the driving shaft 10. For this reason, the die cutting direction of the cylinder block 2 (or the direction in which the center through-hole in the cylinder block extends, or the axial direction of the driving shaft) is equal to the direction in which the radial grooves 41 are depressed. This makes it unnecessary that the radial grooves 41 be additionally processed by cutting, and accordingly to keep the manufacturing costs low.

(6) In the compressor 1 according to the present embodiment, the axial grooves 47 are formed in parts of the inner circumferential surface of the center through-hole 14, which are the parts opposed to the outer periphery of the thrust bearing 16. The axial grooves 47 are provided in the axial direction. The axial grooves 47 communicate with the outer peripheral ends of the radial grooves 41, respectively.

For this reason, even in a case of a structure in which the gap between the inner peripheral surface of the center through-hole 14 and the outer peripheral surface of the thrust bearing 16 is narrow, the cross-sectional area of the first space S1 as a passage is large enough. This ensures that the coolant flows from the crank chamber 5 to the communicating part 41.

Note that the present invention should not be construed as being limited to the foregoing embodiment only.

In the present embodiment, the communicating part 41 is the radial grooves 41 provided in the inner peripheral surface of the center through-hole 14 in the depressed manner. Instead, however, the communicating part may be interstices in the thrust bearing, for example. In this case, the communicating part 41 does not have to be formed separately to pass through the cylinder block 2. This brings about an advantage of keeping the manufacturing costs low.

Furthermore, the foregoing embodiment uses the swash-type inclined plate (or the rotating inclined plate). However, the present invention may use a wobble-type inclined plate (or a non-rotating inclined plate), or an inclined plate of any other type. Moreover, other various modifications can be applied to the present invention within the technical scope of the present invention.

Entire contents of Japanese Patent Application No. 2007-169309 (filed on Jun. 27, 2007) are included in the specification of the present application as reference.

What is claimed is:

1. A compressor, comprising:

a cylinder block including a center through-hole and cylinder bores provided around the center through-hole;

a partition plate which is jointed to a top-dead-center-side surface of the cylinder block, and which includes intake holes and exhaust holes;

an intake chamber and an exhaust chamber communicating with each of the cylinder bores wherein the partition plate is interposed between the intake chamber and the cylinder bores and the exhaust chamber and the cylinder bores;

a crank chamber communicating with the cylinder bores in bottom-dead-center sides of the cylinder bores;

pistons reciprocatably arranged in the respective cylinder bores;

a driving shaft pivotally supported by the center through-hole in the cylinder block, wherein a radial bearing and a thrust bearing are interposed between the driving shaft and the cylinder block;

a conversion mechanism for converting rotations of the driving shaft to reciprocating motions of each of the pistons; and an air bleed passage allowing the crank chamber and the intake chamber to communicate with each other, wherein the center through-hole in the cylinder block includes:

a first space between the crank chamber and the thrust bearing, wherein the first space is closer to the crank chamber than the thrust bearing;

a second space between the thrust bearing and the radial bearing; and a third space between the intake chamber and the radial bearing, wherein the third space is closer to the intake chamber than the radial bearing, wherein the air bleed passage includes:

the first space in the center through-hole;

a communicating part for allowing the first space and the second space to communicate with each other;

the second space in the center through-hole;

a penetrating passage formed so as to pass through the driving shaft, thereby allowing the second space and the third space to communicate with each other;

the third space; and a communicating passage for allowing the third space and the intake chamber to communicate with each other, and wherein coolant gas flows from the crank chamber to the intake chamber through the air bleed passage such that most of the coolant gas flows from the first space to the second space through the communicating part.

2. The compressor according to claim 1, wherein the communicating part for allowing the first space and the second space to communicate with each other is a radial groove formed in a bearing surface for the thrust bearing, the bearing surface being a part of a inner peripheral surface of the center through-hole in the cylinder block.

3. The compressor according to claim 2, wherein a plurality of radial grooves are provided radiating from the second space to a outer periphery of the center through-hole.

4. The compressor according to claim 2, wherein the radial grooves are provided to be depressed from the bearing surface in an axis direction of the driving shaft.

5. The compressor according to claim 3, wherein the radial grooves are provided to be depressed from the bearing surface in an axis direction of the driving shaft.

6. The compressor according to claim 2, wherein axial grooves are formed in a part of the inner peripheral surface of the center through-hole, which part faces the outer periphery of the thrust bearing, the axial grooves being provided in the axis direction to communicate with outer peripheral ends of the respective radial grooves.

7. The compressor according to claim 3, wherein axial grooves are formed in a part of the inner peripheral surface of the center through-hole, which part faces the outer periphery of the thrust bearing, the axial grooves being provided in the axis direction to communicate with outer peripheral ends of the respective radial grooves.

8. The compressor according to claim 4, wherein axial grooves are formed in a part of the inner peripheral surface of the center through-hole, which part faces the outer periphery of the thrust bearing, the axial grooves being provided in the axis direction to communicate with outer peripheral ends of the respective radial grooves.

9. The compressor according to claim 5, wherein axial grooves are formed in a part of the inner peripheral surface of the center through-hole, which part faces the outer periphery of the thrust bearing, the axial grooves being provided in the axis direction to communicate with outer peripheral ends of the respective radial grooves.

10. The compressor according to claim 9, wherein the radial bearing is a slide bearing.

11. The compressor according to claim 2, wherein the radial bearing is a slide bearing.

12. The compressor according to claim 3, wherein the radial bearing is a slide bearing.

13. The compressor according to claim 4, wherein the radial bearing is a slide bearing.

14. The compressor according to claim 5, wherein the radial bearing is a slide bearing.

15. The compressor according to claim 6, wherein the radial bearing is a slide bearing.

16. The compressor according to claim 7, wherein the radial bearing is a slide bearing.

17. The compressor according to claim 8, wherein the radial bearing is a slide bearing.

18. The compressor according to claim 9, wherein the radial bearing is a slide bearing.

* * * * *